US011391076B2

(12) United States Patent
Rupp et al.

(10) Patent No.: US 11,391,076 B2
(45) Date of Patent: Jul. 19, 2022

(54) RAIL FOR GUIDING A CARRIAGE OF A FURNITURE DOOR

(71) Applicant: Julius Blum GmbH, Hoechst (AT)

(72) Inventors: Matthias Rupp, Hohenweiler (AT); Ingo Gasser, Hoechst (AT); Franz Kohlweiss, Hard (AT)

(73) Assignee: JULIUS BLUM GMBH, Hoechst (AT)

( * ) Notice: Subject to any disclaimer, the term of this patent is extended or adjusted under 35 U.S.C. 154(b) by 274 days.

(21) Appl. No.: 16/653,237

(22) Filed: Oct. 15, 2019

(65) Prior Publication Data

US 2020/0040632 A1 Feb. 6, 2020

Related U.S. Application Data

(63) Continuation of application No. PCT/AT2018/000039, filed on May 4, 2018.

(30) Foreign Application Priority Data

May 11, 2017 (AT) ..... A 50391/2017

(51) Int. Cl.
*E05D 15/26* (2006.01)
*A47B 61/00* (2006.01)
*A47B 77/08* (2006.01)

(52) U.S. Cl.
CPC ..... *E05D 15/266* (2013.01); *A47B 61/00* (2013.01); *A47B 77/08* (2013.01); *E05Y 2900/212* (2013.01)

(58) Field of Classification Search
CPC ..... A47B 61/00; A47B 77/08; E05D 15/266
USPC ..... 16/96 R; 312/334.1, 322
See application file for complete search history.

(56) References Cited

U.S. PATENT DOCUMENTS

| | | | | |
|---|---|---|---|---|
| 6,155,661 | A * | 12/2000 | O'Neil | A47B 88/467 312/333 |
| 7,065,831 | B2 | 6/2006 | Elmer | |
| 8,336,972 | B2 | 12/2012 | Haab et al. | |
| 8,522,398 | B2 | 9/2013 | Haab et al. | |
| 2004/0080244 | A1* | 4/2004 | Lowther, Jr. | H05K 7/1488 312/205 |
| 2004/0239216 | A1 | 12/2004 | Castillo | |
| 2005/0102792 | A1 | 5/2005 | Elmer | |
| 2009/0066202 | A1* | 3/2009 | Meltzer | B42F 13/26 312/184 |
| 2010/0269291 | A1 | 10/2010 | Haab et al. | |

(Continued)

FOREIGN PATENT DOCUMENTS

| | | |
|---|---|---|
| CN | 1524154 | 8/2004 |
| CN | 101876228 | 11/2010 |

(Continued)

OTHER PUBLICATIONS

International Search Report dated Aug. 6, 2018 in International (PCT) Application No. PCT/AT2018/000039.

*Primary Examiner* — James O Hansen
(74) *Attorney, Agent, or Firm* — Wenderoth, Lind & Ponack, L.L.P.

(57) ABSTRACT

A rail for guiding a carriage of a furniture door, in which the rail has at least one mounting part. The at least one mounting part can be fastened to a furniture part, which is formed by a side wall of a piece of furniture, and can be releasably connected to a guide part. The guide part has at least one guide for the carriage.

16 Claims, 7 Drawing Sheets

(56) References Cited

U.S. PATENT DOCUMENTS

| | | | | |
|---|---|---|---|---|
| 2010/0270898 | A1 | 10/2010 | Haab et al. | |
| 2013/0097811 | A1 | 4/2013 | Wilbs | |
| 2013/0232878 | A1* | 9/2013 | Bortoluzzi | E05D 15/58 49/252 |
| 2014/0150208 | A1 | 6/2014 | Haab et al. | |
| 2020/0048947 | A1* | 2/2020 | Blum | E06B 3/5045 |

FOREIGN PATENT DOCUMENTS

| | | |
|---|---|---|
| DE | 28 51 094 | 6/1980 |
| DE | 103 23 695 | 1/2005 |
| EP | 2 317 052 | 5/2011 |
| EP | 2 740 870 | 6/2014 |
| JP | 2004-137789 | 5/2004 |
| KR | 20090093157 | 9/2009 |

* cited by examiner

C-C

RAIL FOR GUIDING A CARRIAGE OF A FURNITURE DOOR

BACKGROUND OF THE INVENTION

The present invention relates to a rail for guiding a carriage of a furniture door and a piece of furniture with at least one such rail.

In addition, the invention relates to a method for producing such a piece of furniture.

Rails for guiding a carriage of a furniture door which are arranged as a complete package on a side panel of a piece of furniture are already known. This means that the rails are fastened to the side panel for example by means of screws. This has the disadvantage that the entire rail has to be unscrewed again in the event of maintenance work or other repairs. Furthermore, after the maintenance work or repairs have been carried out, the rail has to be fastened to the side panel again, with the result that new fastening holes may be necessary in order to guarantee a secure hold of the rail, and thus of the furniture door.

SUMMARY OF THE INVENTION

The object of the invention is to avoid the above-described disadvantages and to specify an improved rail compared with the state of the art and an improved piece of furniture, with the result that carrying out maintenance work or other repairs is made easier.

A further object of the invention is to specify an improved method for producing such a piece of furniture, in order in turn to make it easier to carry out maintenance work.

An essential idea with respect to the rail according to the invention is that the rail has at least one installation part, wherein the at least one installation part is fastenable to a furniture part, which is formed by a side panel of a piece of furniture, and releasably connectable to a guide part, wherein the guide part has at least one guide for the carriage. In other words, it is thus possible to connect only the installation part fixedly to the piece of furniture, wherein a guide part can be arranged on this installation part. Thus, an important advantage is that the rail according to the invention can also be arranged in narrow slots. The installation part needs to be fastened to a furniture part only once, wherein only the connection between installation part and guide part needs to be released to carry out maintenance work or other repairs, with the result that the installation part can remain on the furniture part.

In order that the above-named work is additionally made easier, it can moreover be provided that the at least one installation part is formed as a, preferably profiled, installation rail, wherein the guide rail is displaceably mounted on the installation rail. The guide rail can thus be displaced along the installation rail, with the result that the connection between the guide part and the installation part can be released by a displacement of these two parts relative to each other.

In the case of a piece of furniture with at least one furniture door, in particular a folding-sliding door, at least one rail and at least one carriage arranged on the at least one furniture door, it can be provided that the piece of furniture has at least two rails arranged one over the other and at least two carriages. Larger furniture doors can thereby be guided with the aid of the rails.

BRIEF DESCRIPTION OF THE DRAWINGS

Further advantages and details of the invention are revealed by the figures and the associated description of the figures, wherein the method according to the invention is also explained in more detail with reference to the description of the figures. There are shown in.

DETAILED DESCRIPTION OF THE INVENTION

Figure 1A:
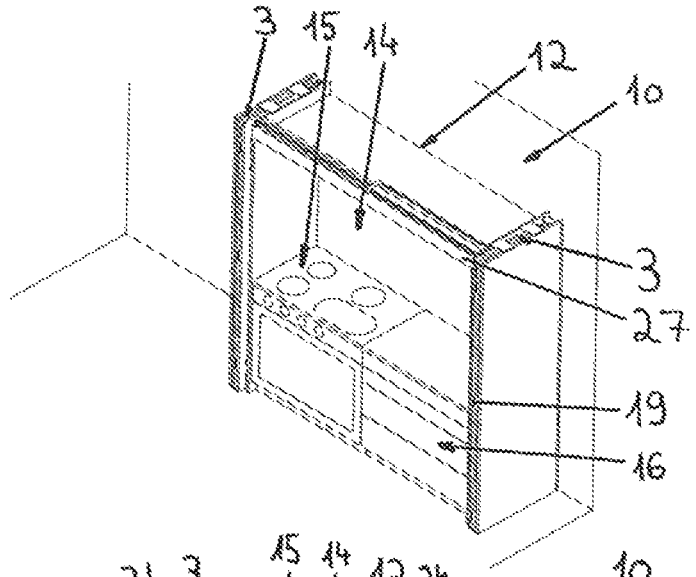
FIGS. 1*a*-1*c* perspective views of a piece of furniture with two folding-sliding doors, wherein the folding-sliding doors are represented in different positions, FIG. 2 a side panel and two rails in a perspective view, FIG. 3 a side panel with two rails arranged thereon in a perspective view, FIGS. 4*a*-4*d* detail representations of the side panel and the rails, FIGS. 5*a*-5*d* detail and sectional representations of the side panel and the rails, FIG. 6 a side panel with installed installation part and guide part displaced thereon in a perspective view, and FIG. 7 a side panel with installed installation part in a perspective view, wherein the connection between installation part and guide part has been fully released.
Figure 1B:
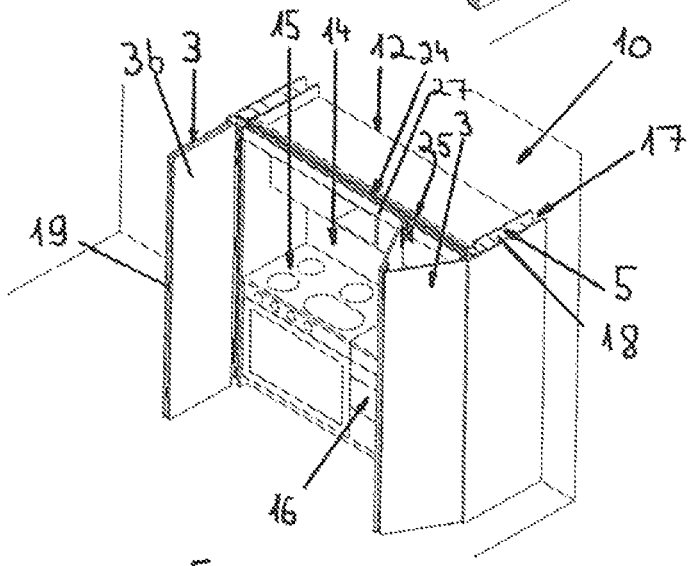
Figure 1C:
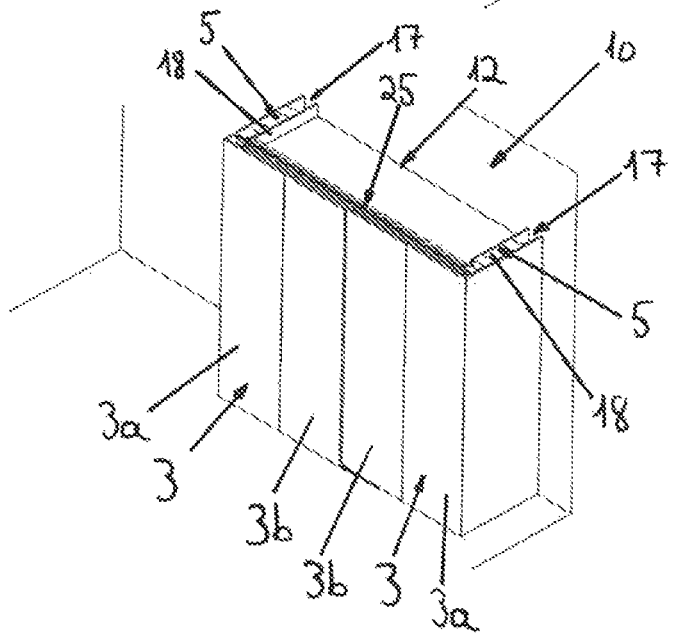

FIGS. 1*a*, 1*b* and 1*c* show a piece of furniture 10, with a fixed part 12, two furniture parts 5 formed by the side panels 18 and two furniture doors 3. These two furniture doors 3 are formed as folding-sliding doors with a first door leaf 3*a* and a second door leaf 3*b*, wherein the two door leaves 3*a*, 3*b* can be folded via the folding door hinge 19. The piece of furniture 10 furthermore has a receiving area 14 and two laterally arranged receiving slots 17 or "pockets". It is thus provided that the piece of furniture 10 has a receiving area 14 for receiving components of a kitchen 15 (for example electrical devices such as hob, oven, etc.), a clothes-storage device 16 (for example drawers, clothes hangers, boxes, etc.), or the like.

In addition, it is provided that the piece of furniture 10 has at least one receiving slot 17, which is preferably arranged laterally in or on the piece of furniture 10 and into which the at least one furniture door 3 is retractable. Thus either the receiving slot 17 can be arranged on the piece of furniture 10 from the outside or else the receiving slot 17 is formed in the piece of furniture 10, for example by the arrangement of an additional panel. In the receiving slots 17 or, more precisely, on the side panels 18 the rails 1 (not visible) are arranged for guiding the carriages 2 of the furniture doors 3, with the result that the furniture doors 3 are retractable into these receiving slots 17. The two receiving slots 17 have a clear width of from 10 to 30 cm and/or a height of from 100 to 250 cm and/or a depth of from 60 to 100 cm.

The representation shown in FIG. 1*a* corresponds to the parked position of the furniture doors 3 and that in FIG. 1*c* corresponds to the closed position of the furniture doors 3. The second door leaf 3*b* is in each case coupled to a slide mechanism 25, wherein the slide mechanism 25 is displaceable along a slide mechanism rail 24. This slide mechanism rail 24 is arranged substantially transverse to the rails 1 on the piece of furniture 10. In addition, a bar 27 is provided which either is part of the slide mechanism rail 24 or is designed as a component separate therefrom. The movement of the furniture doors 3 between the parked position and the closed position is thus made possible by the rails 1 and the slide mechanism rail 24. Starting from the parked position of the furniture doors 3, in which the door leaves 3*a*, 3*b* are aligned substantially parallel to each other, the furniture doors 3 can thus be moved into the position in FIG. 1*b*, which can be seen with reference to the furniture doors 3 represented on the left. In the process, the furniture doors 3 are displaced along the rails 1. Subsequently, the furniture doors 3 are brought into the substantially coplanar position according to FIG. 1*c*. For this, in each case the door leaf 3*b* is displaced with the aid of the slide mechanism 25 along the slide mechanism rail 24, until the closed position of the furniture doors 3 is reached, in which the two door leaves 3*a*, 3*b* are aligned substantially coplanar. The same process is passed through in reverse order to move the furniture doors 3 from their closed position into their parked position.

Figure 2:
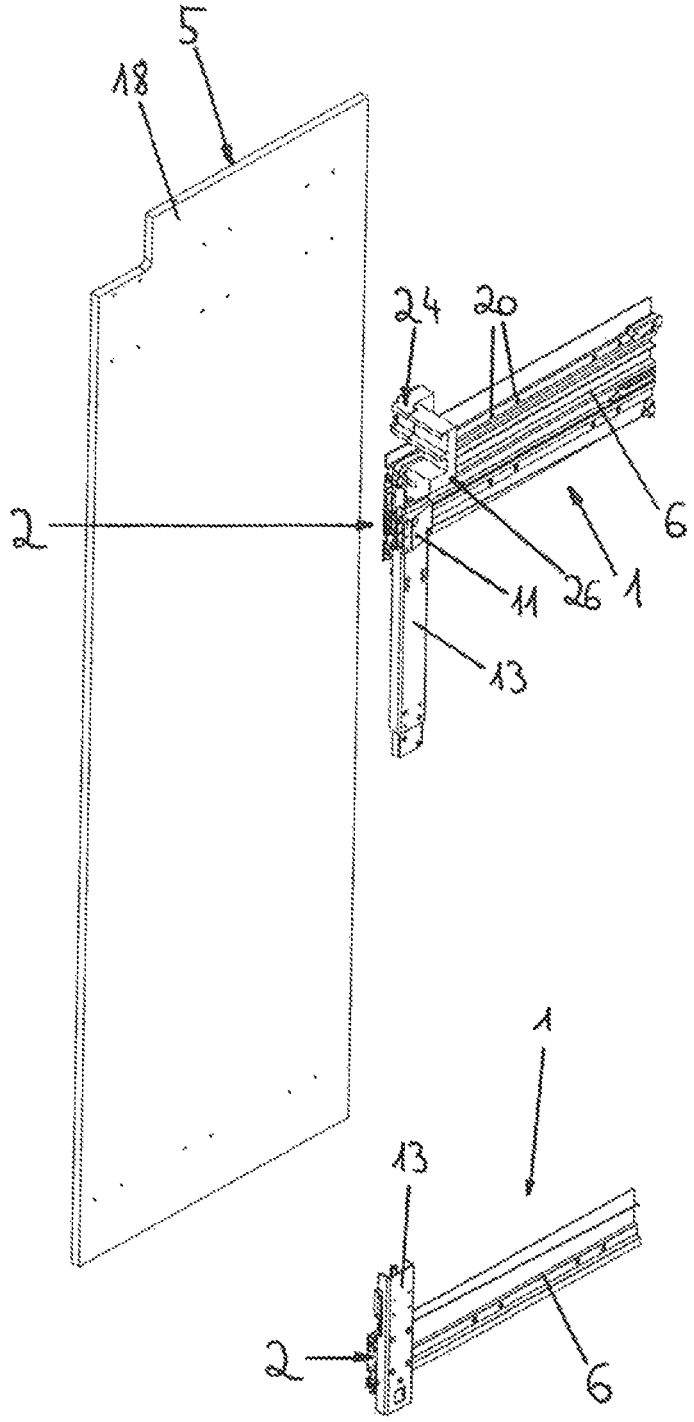

FIG. 2 shows the furniture part 5 which is formed by the side panel 18. Furthermore, the two rails 1 can be seen, which in each case comprise the guide part 6. Moreover, two of the many passage openings are provided with the reference number 20. A carriage 2 is coupled in each case to the two rails 1, wherein the vertical supporting structure 13 and the connecting piece 26 for the slide mechanism rail 24 are arranged on these two carriages 2. The connecting piece 26 is formed as a support. In order to make it possible to displace the furniture doors 3 along the rail 1, the slide mechanism 25 is displaced on this connecting piece 26, with the result that the door leaves 3*a*, 3*b* are aligned substantially parallel to each other. A hinge 11, which is connectable to a furniture door 3 or to the first door leaf 3*a* of the furniture door 3, is arranged on the supporting structure 13. In the case of a piece of furniture 10, at least one hinge 11 can thus be provided for the movable mounting of the at least one furniture door 3 relative to at least one fixed part 12 of the piece of furniture 10, preferably wherein the piece of furniture 10 has at least one, preferably vertical, supporting structure 13 and at least one hinge 11 is arranged on the at least one supporting structure 13.

Figure 3:
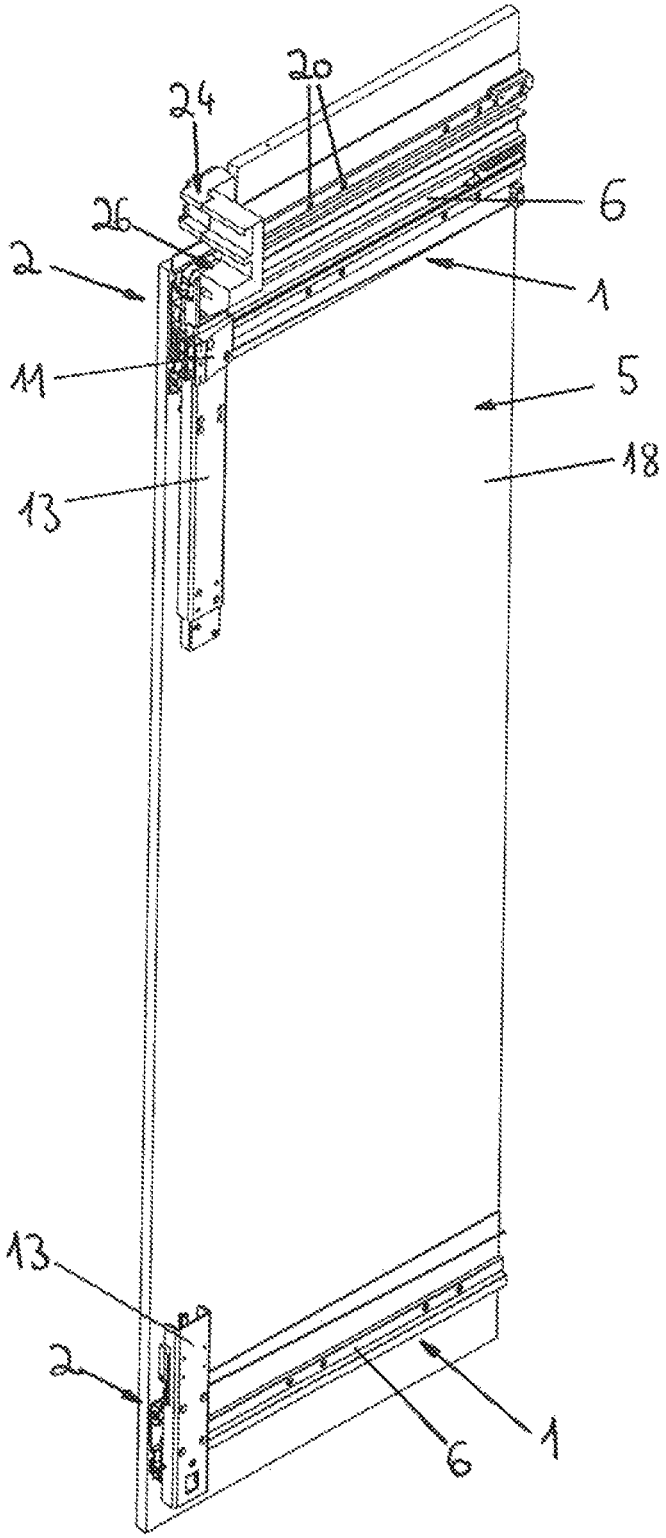

FIG. 3 shows the rails 1 installed on the side panel 18.

Figure 4A:
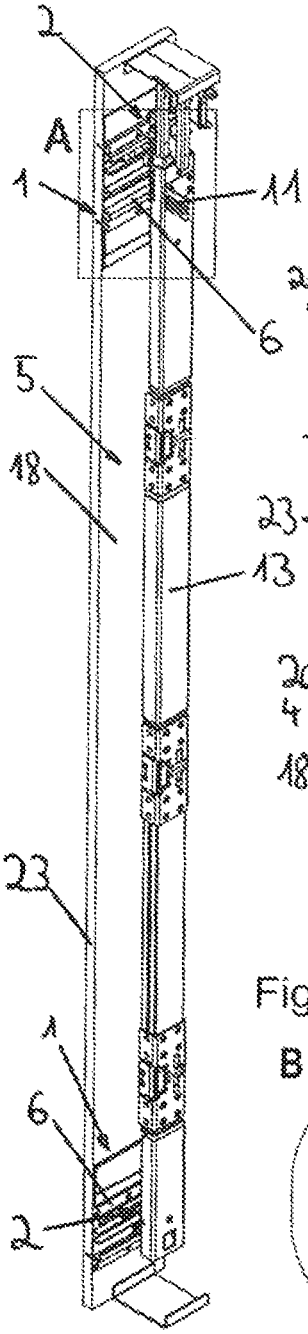
Figure 4B:
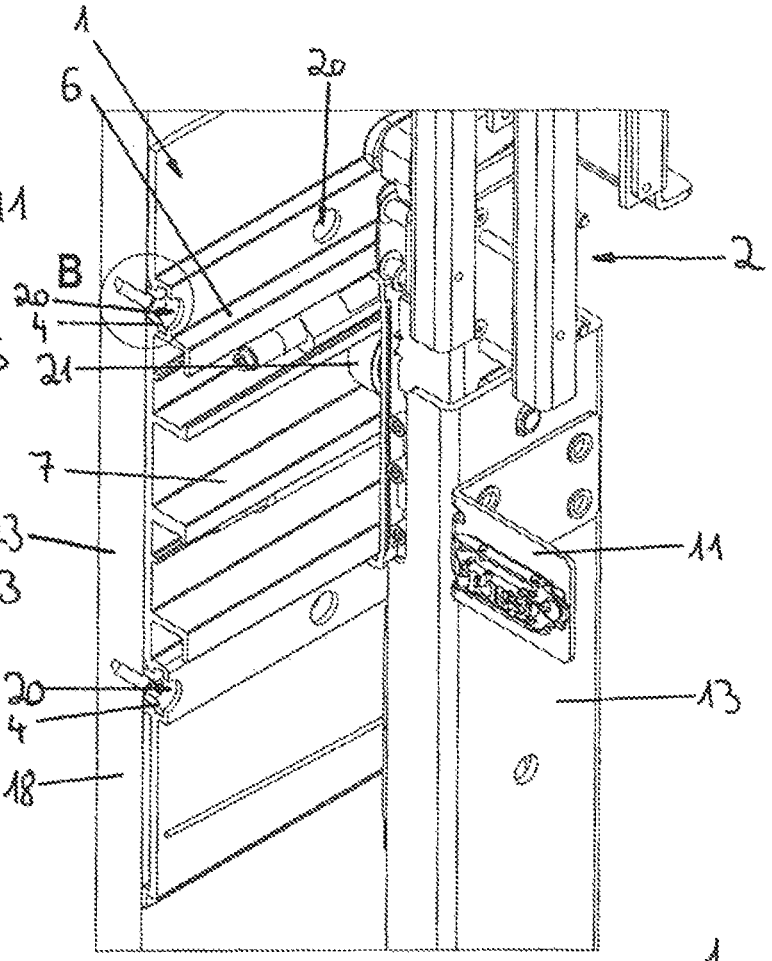

FIG. 4*a* shows a sectional representation of the side panel 18 with rails 1 installed thereon, wherein the carriages 2 are displaced along the guide 7 of the guide parts 6 in the direction away from the front face 23 of the side panel 18. FIG. 4*b* shows a detail view of the area A of FIG. 4*a*. The rail 1 can be seen here, which has the guide part 6 and the two installation parts 4. The two installation parts 4 are formed as profiled installation rails. Furthermore, the guide part 6 has a guide 7 for the roller 21 of the carriage 2. The carriage 2 is thereby movable along the guide 7 with the beam 13 and the furniture doors 3 arranged thereon (not represented). In addition, the two passage openings 20 of the guide part 6 can be seen more precisely.

Figure 4C:
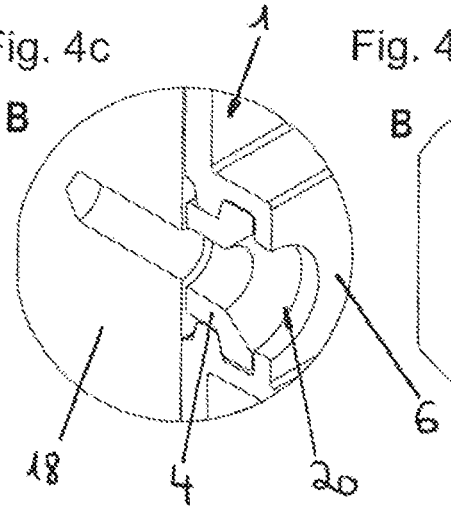
Figure 4D:
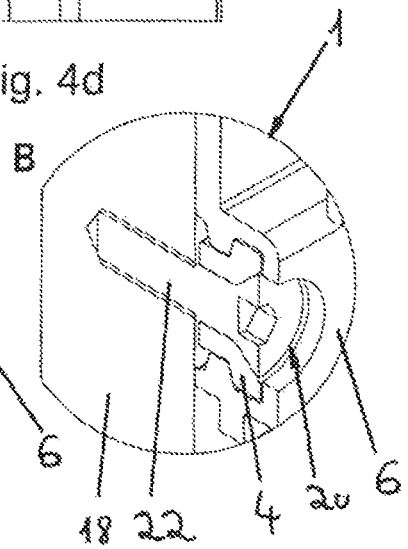

FIGS. 4*c* and 4*d* show a detail representation of the area B of FIG. 4*b*. In contrast to FIG. 4*c*, in FIG. 4*d* a fastener 22 is represented which serves to arrange the rail 1 on the side panel 18. For example screws are suitable as fasteners 22. It is provided that the at least one installation part 4 formed as an installation rail is formed substantially T-shaped in a side view. Alternatively, the at least one installation part 4 formed as an installation rail could be formed substantially dovetail-shaped in a side view. The passage openings 20 additionally ensure that the guide part 6 is displaceable along the installation parts 4. The fasteners 22 are namely screwed through these passage openings 20, with the result that the fastener 22 does not prevent the displacement of the guide part 6 along the installation parts 4 (i.e., does not directly contact guide part 6).

Figure 5A:
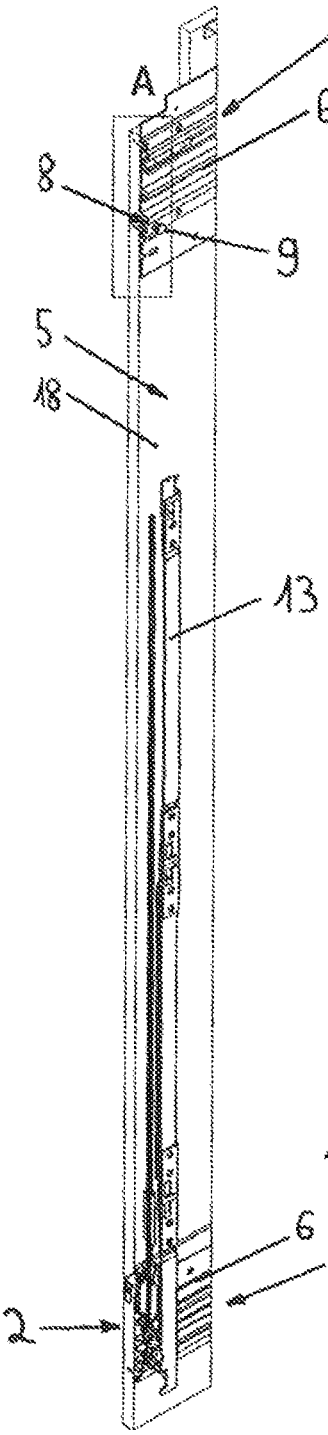
Figure 5B:
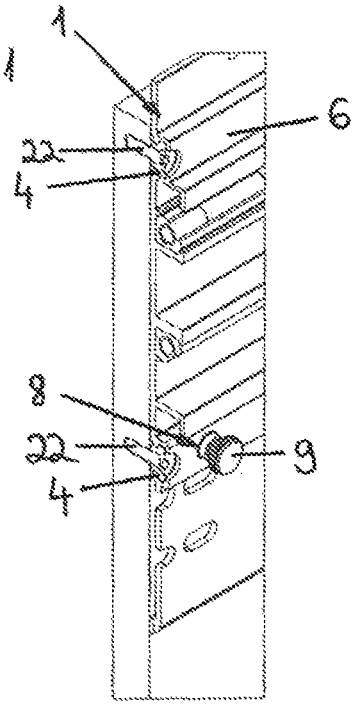

FIG. 5*a* shows a section of the side panel 18, wherein the representation of the beam 13 and the carriage 2 connected thereto have been dispensed with in the area of the upper rail 1. The releasable locking mechanism 8 is thereby recognizable. FIG. 5*b* shows a detail representation of the area A of FIG. 5*a*. The locking screw 9 is shown here, which is a component of the releasable locking mechanism 8. For example knurled screws or grub screws are suitable as locking screw 9. The rail 1 thus has a releasable locking mechanism 8, with which the mutual position of the at least one installation part 4 and the guide part 6 can be set. It can be provided that the releasable locking mechanism 8 has at least one locking screw 9.

Figure 5C:
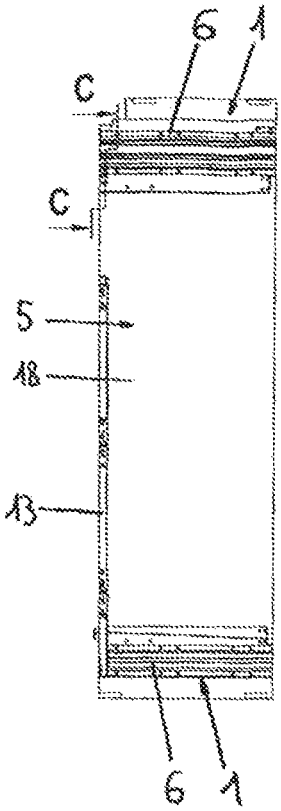
Figure 5D:
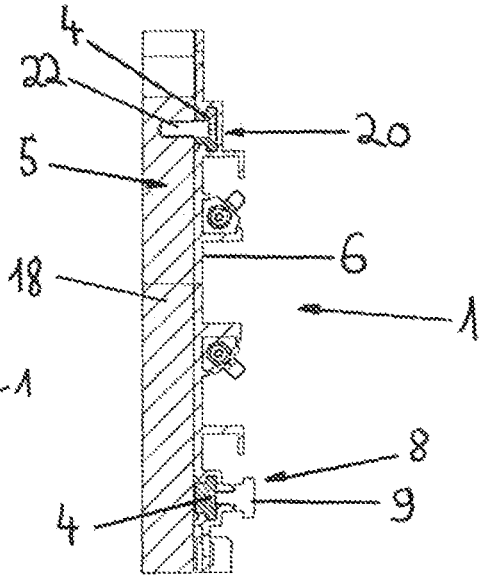

FIG. 5*c* shows the side panel 18 with the rails 1 arranged thereon in a top view. FIG. 5*d* shows the section C-C according to FIG. 5*c*. It is recognizable here that the installation parts 4 of the rail 1 are connected to the side panel 18 by the fastener 22. The fastener 22 has thus been guided through the passage opening 20 and is not in direct contact with the guide part 6, with the result that the guide part 6 is displaceable along the installation parts 4. In the lower area of the representation, the releasable locking mechanism 8 is shown, which is in connection only with the installation part 4 and the guide part 6. This releasable locking mechanism 8 comprises the locking screw 9, the external thread of which cooperates with a corresponding internal thread on the guide part 6.

Figure 6:
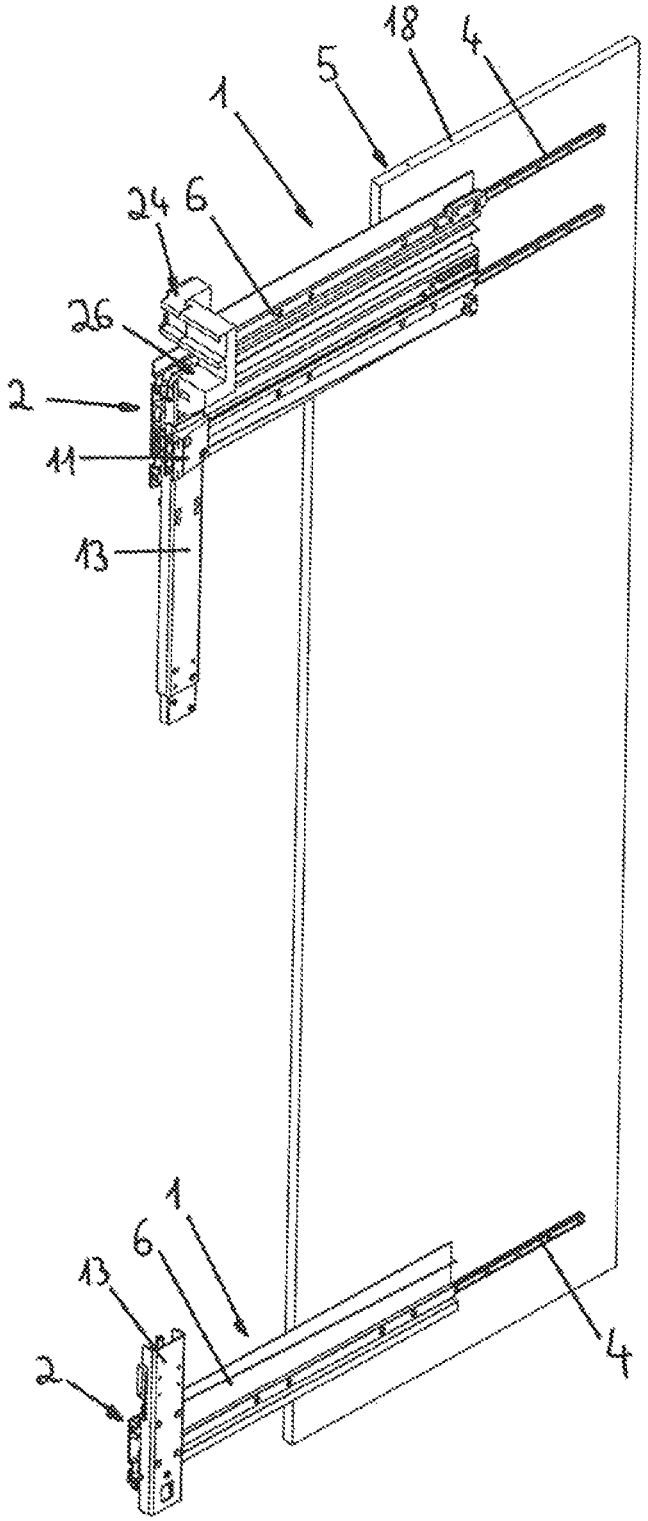

FIG. 6 shows the side panel 18 with the installation parts 4, which are formed as profiled installation rails, arranged thereon. Three installation parts 4 arranged one over another are provided. The two upper installation parts 4 are releasably connectable to the guide part 6 of the upper rail 1 and the lower installation part 4 is releasably connectable to the guide part 6 of the lower rail 1. The guide parts 6 of the rails 1 are displaced along the installation rails in the representation.

Figure 7:
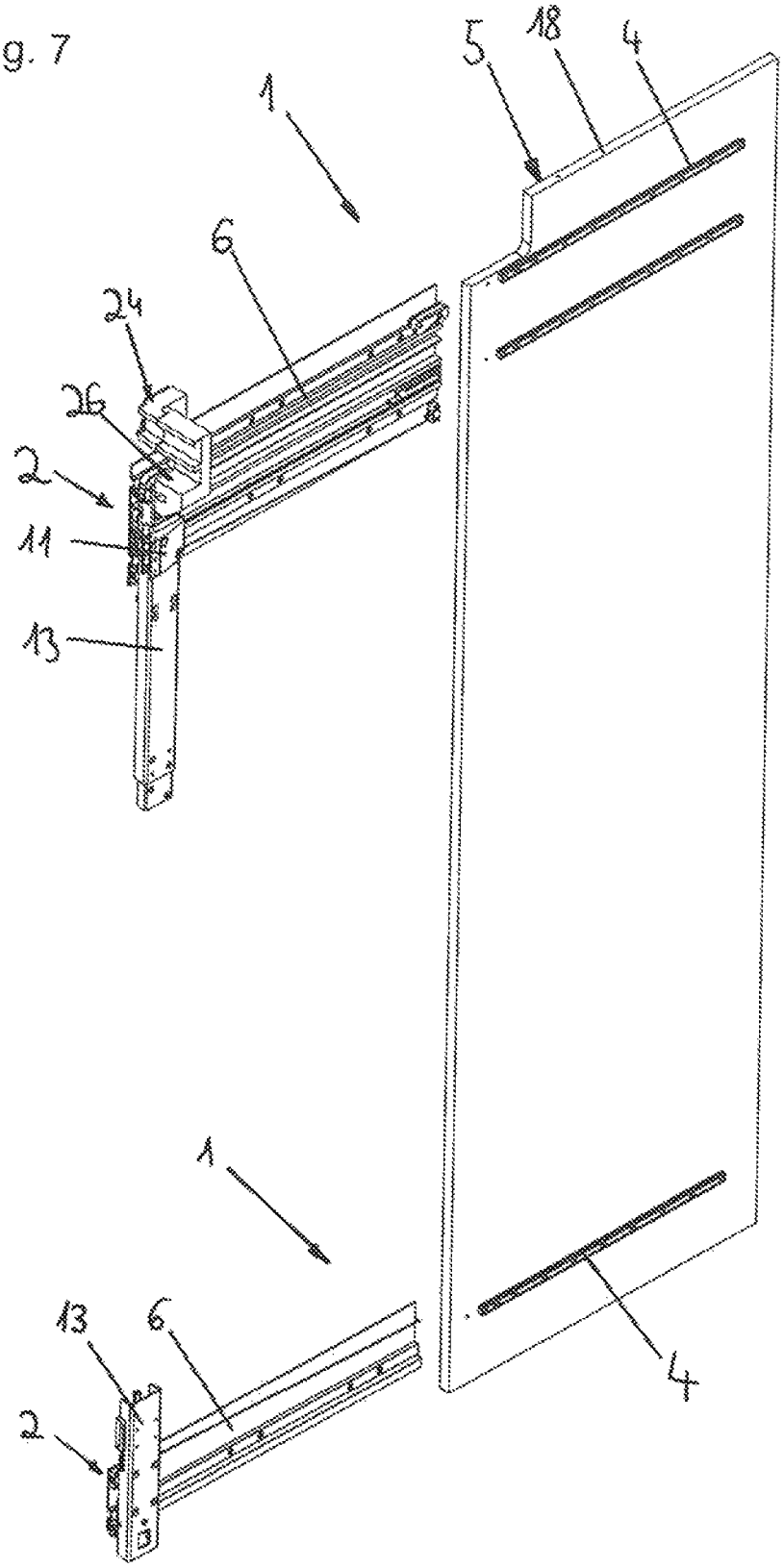

FIG. 7 shows a development of FIG. 6. The guide parts 6 of the rails 1 have been fully released from the installation parts 4 formed as profiled installation rails.

The method according to the invention is explained with reference to FIGS. 4*a* to 4*d*, 5*a* to 5*d* and with reference to FIG. 6.

Providing a piece of furniture 10 with at least one side panel 18,

Installing the at least one rail 1 on the at least one side panel 18 of the piece of furniture 10 via the at least one installation part 4, Providing at least one furniture door 3, Providing at least one carriage 2, and Arranging the at least one carriage 2 on the at least one furniture door 3 and coupling the at least one carriage 2 to the at least one guide 7 of the guide part 6 of the rail 1.

To carry out maintenance work, the following steps are carried out:

Releasing a releasable locking mechanism 8, with which the mutual position of the at least one installation part 4 and the guide part 6 is set, Displacing the guide part 6 relative to the at least one installation part 4 in the direction of a person carrying out the maintenance work, and Carrying out the maintenance work.

In relation to the embodiment example, it is pointed out that the locking screw 9 is released to release the releasable locking mechanism 8, with the result that the locking screw 9 no longer cooperates with the installation part 4 of the rail 1.

After the maintenance work has been carried out, the following steps are carried out:

Displacing the guide part 6 relative to the at least one installation part 4 into the original position of the guide part 6, and Locking the mutual position of the at least one installation part 4 and the guide part 6 by means of the releasable locking mechanism 8.

For the locking, in the embodiment example shown, the locking screw 9 is turned back in the direction of the installation part 4, until the locking screw 9 cooperates with the installation part 4 again and prevents a displacement of the installation part 4 relative to the guide part 6.

LIST OF REFERENCE NUMBERS

1 rail
2 carriage
3 furniture door
3*a* first door leaf
3*b* second door leaf
4 installation part
5 furniture part
6 guide part
7 guide
8 releasable locking mechanism
9 locking screw
10 piece of furniture
11 hinge
12 fixed part of the piece of furniture
13 supporting structure
14 receiving area
15 components of a kitchen
16 clothes-storage device
17 receiving slot
18 side panel
19 folding door hinge
20 passage opening
21 roller
22 fastener
23 front face
24 slide mechanism rail
25 slide mechanism
26 connecting piece
27 bar

The invention claimed is:

1. A piece of furniture comprising:
a furniture door;
a carriage arranged on the furniture door;
a receiving slot into which the furniture door is retractable; and
a rail configured to guide the carriage of the furniture door,
wherein the rail includes an installation rail and a guide part displaceably mounted on the installation rail, the guide part having a guide for guiding the carriage,
wherein the installation rail is fastenable to a furniture part by a fastener and releasably connectable to the guide part, the guide part having passage openings and the fastener being guidable through the passage openings, and
wherein the fastener and the guide part are configured such that, when the installation rail is fastened to the furniture part, the fastener does not directly contact the guide part.

2. The piece of furniture according to claim 1, wherein the installation rail is a profiled installation rail.

3. The piece of furniture according to claim 1, wherein the installation rail is dovetail-shaped or T-shaped in a side view.

4. The piece of furniture according to claim 1, further comprising a releasable locking mechanism, with which the mutual position of the at least one installation part and the guide part can be set.

5. The piece of furniture according to claim 1, wherein the releasable locking mechanism includes a locking screw.

6. The piece of furniture according to claim 1, wherein the furniture door is a folding-sliding door.

7. The piece of furniture according to claim 1, wherein the rail is one of at least two rails arranged one over the other, and the carriage is one of at least two carriages to be guided by the at least two rails.

8. The piece of furniture according to claim 1, further comprising a hinge configured to movably mount the furniture door relative to a fixed part of the piece of furniture.

9. The piece of furniture according to claim 8, further comprising a vertical supporting structure, and the hinge is arranged on the vertical supporting structure.

10. The piece of furniture according to claim 1, further comprising a receiving area for receiving components of a kitchen or a clothes-storage device.

11. The piece of furniture according to claim 1, wherein the receiving slot is arranged laterally in or on a body of the piece of furniture.

12. The piece of furniture according to claim 1, wherein the receiving slot has a clear width in a range of 10 cm to 30 cm, and has a height in a range of 100 cm to 250 cm and a depth in a range of 60 cm to 100 cm.

13. A method for producing a piece of furniture according to claim 1, the method comprising:
providing the piece of furniture having a side panel;
installing the rail on the side panel of the piece of furniture via the installation rail;
providing the furniture door;
providing the carriage; and
arranging the carriage on the furniture door and coupling the carriage to the guide of the guide part of the rail.

14. The method according to claim 13, further comprising carrying out maintenance work by:
releasing a releasable locking mechanism, with which a position of both the installation rail and the guide part is set;
displacing the guide part relative to the installation rail in a direction of a person carrying out the maintenance work; and
carrying out the maintenance work.

15. The method according to claim 14, wherein, after carrying out the maintenance work, performing the following:
displacing the guide part relative to the installation rail into an original position of the guide part; and
locking the mutual position of the installation rail and the guide part by the releasable locking mechanism.

16. The piece of furniture according to claim 1, wherein the furniture part is a side panel.

* * * * *